US010724822B1

(12) United States Patent
Chuang

(10) Patent No.: US 10,724,822 B1
(45) Date of Patent: Jul. 28, 2020

(54) TOY GUN CAPABLE OF QUICKLY PIERCING AIR BOTTLE

(71) Applicant: Hsiang-Wen Chuang, New Taipei (TW)

(72) Inventor: Hsiang-Wen Chuang, New Taipei (TW)

( * ) Notice: Subject to any disclaimer, the term of this patent is extended or adjusted under 35 U.S.C. 154(b) by 0 days.

(21) Appl. No.: 16/847,084

(22) Filed: Apr. 13, 2020

(51) Int. Cl.
*F41B 11/62* (2013.01)
*F41B 11/73* (2013.01)

(52) U.S. Cl.
CPC ..... *F41B 11/62* (2013.01); *F41B 11/73* (2013.01)

(58) Field of Classification Search
CPC ..... F41B 11/62; F41B 11/73; F41B 11/72; F41B 11/721; F41B 11/723
USPC ..... 124/64, 65, 66, 71, 73, 74
See application file for complete search history.

(56) References Cited

U.S. PATENT DOCUMENTS 3,207,143 A * 9/1965 Kline ..... F41B 11/62 124/76
5,363,834 A * 11/1994 Stuchlik ..... F41B 11/62 124/69
5,711,286 A * 1/1998 Petrosyan ..... F41B 11/55 124/53
10,352,647 B1 * 7/2019 Wei ..... F41B 11/89
2015/0300771 A1 * 10/2015 Tseng ..... F41B 11/62 124/74
2018/0164069 A1 * 6/2018 Huang ..... F41B 11/56

FOREIGN PATENT DOCUMENTS

DE 202018105702 * 11/2018 ..... F41B 11/50

* cited by examiner

*Primary Examiner* — Stephen Johnson
(74) *Attorney, Agent, or Firm* — Chun-Ming Shih; HDLS IPR Services

(57) ABSTRACT

A toy gun capable of quickly piercing an air bottle. The toy gun includes a gun body, a piercing seat, a screw base, and a moveable rod assembly. The gun body has an air cylinder receiving the air bottle. A connecting tube and a screwed tube are disposed at both ends of the air cylinder. The piercing seat is in the connecting tube. The screw base has an end screwed to the screwed tube and the other end with a bottom end. The screw base has a throughhole penetrating through the bottom end and communicating with the air cylinder. The movable rod assembly has a push rod moveable to penetrate through the throughhole and to protrude from the bottom end and a return spring flexibly held between the screw base and the push rod.

9 Claims, 4 Drawing Sheets

TOY GUN CAPABLE OF QUICKLY PIERCING AIR BOTTLE

BACKGROUND OF THE INVENTION

Field of the Invention

The present invention relates to a toy gun structure and in particular to a toy gun capable of quickly piercing an air bottle.

Description of Prior Art

The current toy gun which uses an air bottle as a power source to shoot bullets utilizes the air cylinder installed in the gun body to receive the air steel bottle. One end of the air cylinder is provided with a thimble corresponding to the bottle mouth of the air steel bottle; the other end of the air cylinder is screwed to the screw base pressing against the air steel bottle. The screw base can be rotated to push and position the air steel bottle in the gun body. Meanwhile, the bottle mouth of the air steel bottle is pierced to release the compressed air in the air steel bottle and provide the power to shoot bullets.

However, the above-mentioned air steel bottle pushed by rotating the screw base to pierce the bottle mouth suffers the following disadvantages. The screw base needs rotating more turns to push the air steel bottle into the air cylinder, which is time- and labor-consuming for the user and requires improvement, especially in a survival game in which every second counts.

In view of this, the inventor pays special attention to research with the application of related theory and tries to improve and overcome the above disadvantages regarding the prior art, which becomes the improvement target of the inventor.

SUMMARY OF THE INVENTION

The present invention provides a toy gun capable of quickly piercing an air bottle. The toy gun uses the push rod that is pressed to push the air bottle to be pierced by the piercing seat, which can have the effect of quickly piercing the air bottle.

In an embodiment, the present invention provides a toy gun capable of quickly piercing an air bottle installed therein. The toy gun comprises a gun body, a piercing seat, a screw base, and a moveable rod assembly. The gun body has an air cylinder. One end of the air cylinder is provided with a connecting tube; the other end of the air cylinder is provided with a screwed tube. The air bottle is received in the air cylinder. The piercing seat is disposed in the connecting tube. The screw base has an end screwed to the screwed tube and the other end with a bottom end. The screw base is provided with a throughhole penetrating through the bottom end and communicating with the interior of the air cylinder. The moveable rod assembly has a push rod that can move to penetrate through the throughhole and to protrude from the bottom end and a return spring flexibly held between the screw base and the push rod. When the push rod is pressed, the push rod can move the air bottle towards the piercing seat to be pierced by the piercing seat.

Compared with the prior art which needs more turns for the screw seat to push the air bottle into the air cylinder, the push rod used in the present invention is just pressed to push the air bottle into the air cylinder such that the air bottle is quickly pierced by the piercing seat. Therefore, the toy gun of the present invention has the effect of quickly piercing the air bottle.

DETAILED DESCRIPTION OF THE INVENTION

Figure 1:
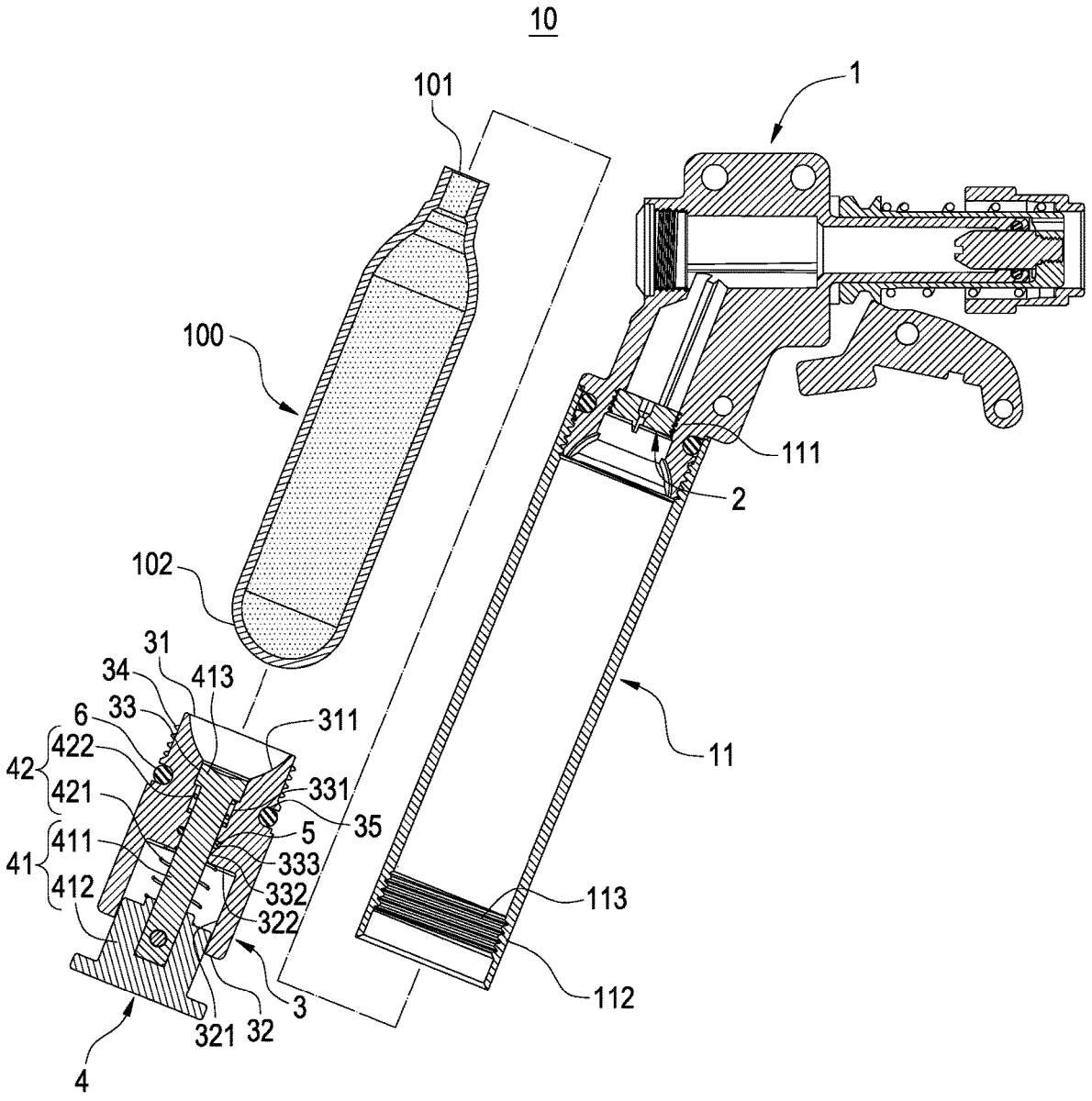
FIG. 1 is a cross-sectional exploded view of the toy gun capable of quickly piercing an air bottle of the present invention.
Figure 2:
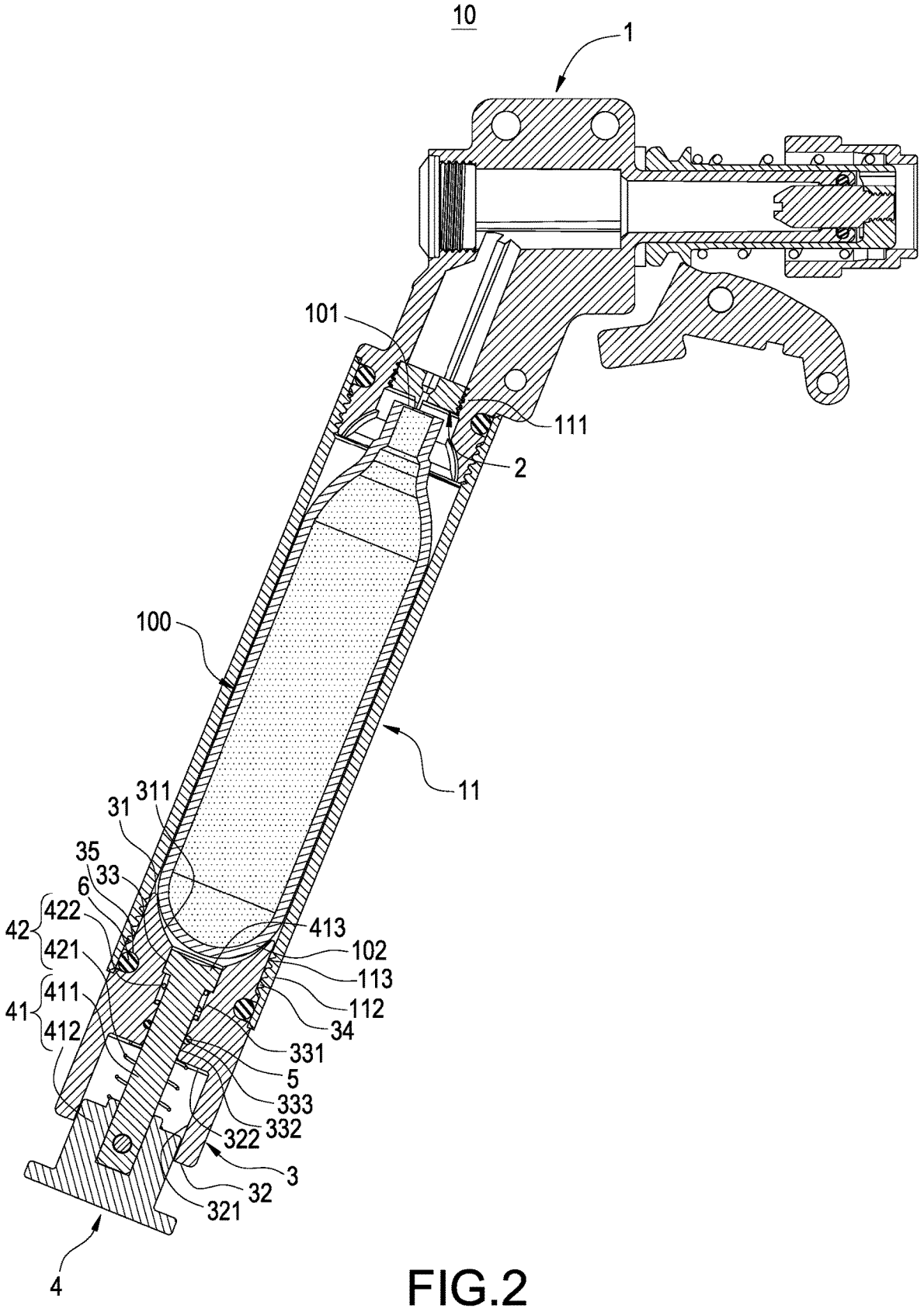
FIG. 2 is a cross-sectional view of the toy gun capable of quickly piercing an air bottle of the present invention.

The detailed description and technical details of the present invention will be explained below with reference to accompanying drawings. However, the accompanying figures are for reference and explanation only, but not to limit the scope of the present invention.

Please refer to FIGS. 1-4. The present invention provides a toy gun capable of quickly piercing an air bottle. The toy gun 10 comprises a gun body 1, a piercing seat 2, a screw base 3, and a moveable rod assembly 4.

The toy gun 10 of the present invention is used to install an air bottle 100. The air bottle 100 has a bottle mouth 101 at one end thereof and a bottle bottom 102 at the other end thereof. The compressed air generated after the air bottle 100 is pierced is used to provide the actuating power for the toy gun 10.

The gun body 1 has an air cylinder 11. One end of the air cylinder 11 is provided with a connecting tube 111 and the other end of the air cylinder 11 is provided with a screwed tube 112. The connecting tube 111 communicates with the gun barrel (not shown) of the gun body 1 and is used to guide the compressed air generated from the air bottle 100 to flow into the gun barrel to shoot the bullets (not shown). An internal thread 113 is disposed at an inner edge of the screwed tube 112.

In addition, the air bottle 100 is received in the air cylinder 11. The bottle mouth 101 of the air bottle 100 is disposed corresponding to the connecting tube 111; the bottle bottom 102 of the air bottle 100 is disposed corresponding to the screwed tube 112. The piercing seat 2 is disposed in the connecting tube 111.

The screw base 3 has an end being a top end 31 and the other end being a bottom end 32. The screw base 3 is provided with a throughhole 33 penetrating through the bottom end 32 and communicating with the interior of the air cylinder 11.

The detailed description is given below. The outer edge of the screw base 3 is provided with an external thread 34 and a second ring groove 35. The external thread 34 and the internal thread 113 are engaged to each other such that the top end 31 of the screw base 3 is screwed to the screwed tube 112.

Moreover, the bottom end 32 is provided with a recess portion 321 and a bottom surface 322 formed in the recess portion 321; the throughhole 33 is formed through the bottom surface 322. The inner edge of the throughhole 33 extends to form a first projection 331, a second projection 332, and a first ring groove 333 disposed between the first projection 331 and the second projection 332. The top end 31 is provided with a U-shaped recess 311 to fit the shape of the bottle bottom 102 of the air bottle 100, but not limited to this.

The moveable rod assembly 4 has a push rod 41 and a return spring 42. The push rod 41 can move to penetrate through the throughhole 33 and to protrude from the bottom end 32. The return spring 42 is flexibly held between the screw base 3 and the push rod 41.

Further description is given below. The push rod 41 has a rod body 411 and a press block 412 attached firmly to the rod body 411. The rod body 411 is disposed through the throughhole 33; the press block 412 protrudes from the bottom end 32 and is moveably embedded in the recess portion 321.

In addition, the extruded part 413 extends from an end of the rod body 411 away from the press block 412. The extruded part 413 can be stopped by the first projection 331 to prevent the rod body 411 from separating from the throughhole 33.

Also, the return spring 42 has a first spring 421 and a second spring 422. The first spring 421 is clamped between the bottom surface 322 and the press block 412. The press block 412 can be returned to protrude from the top end 32 by the spring return force of the first spring 421 and drives the extruded part 413 to be received in the throughhole 33. The second spring 422 is clamped between the extruded part 413 and the second projection 332.

Further description is given below. Without external force applied, the spring return force of the first spring 421 is larger than that of the second spring 422, which drives the extruded part 413 to be received in the throughhole 33 and the second spring 422 not to return to its original length to be in a compressed state. However, when the press block 412 is pressed to compress the first spring 421 to move the rod body 411 towards the interior of the air cylinder 11, the second spring 422 flexibly returns to a stretched state and drives the extruded part 413 to press against the air bottle 100 and prevent the air bottle 100 from swaying.

When the push rod 41 is pressed by the user, the push rod 41 can move the air bottle 100 towards the piercing seat 2 to be pierced by the piercing seat 2.

The toy gun 10 of the present invention further comprises a first seal ring 5 that is clamped between the rod body 411 and the screw base 3; the first seal ring 5 is received and embedded in the first ring groove 333. The first seal ring 5 is used to provide an airtight seal between the rod body 411 and the screw base 3.

The toy gun 10 of the present invention further comprises a second seal ring 6 that is clamped between the screwed tube 112 and the screw base 3; the second seal ring 6 is received and embedded in the second ring groove 35. The second seal ring 6 is used to provide an airtight seal between the screwed tube 112 and the screw base 3.

Figure 3:
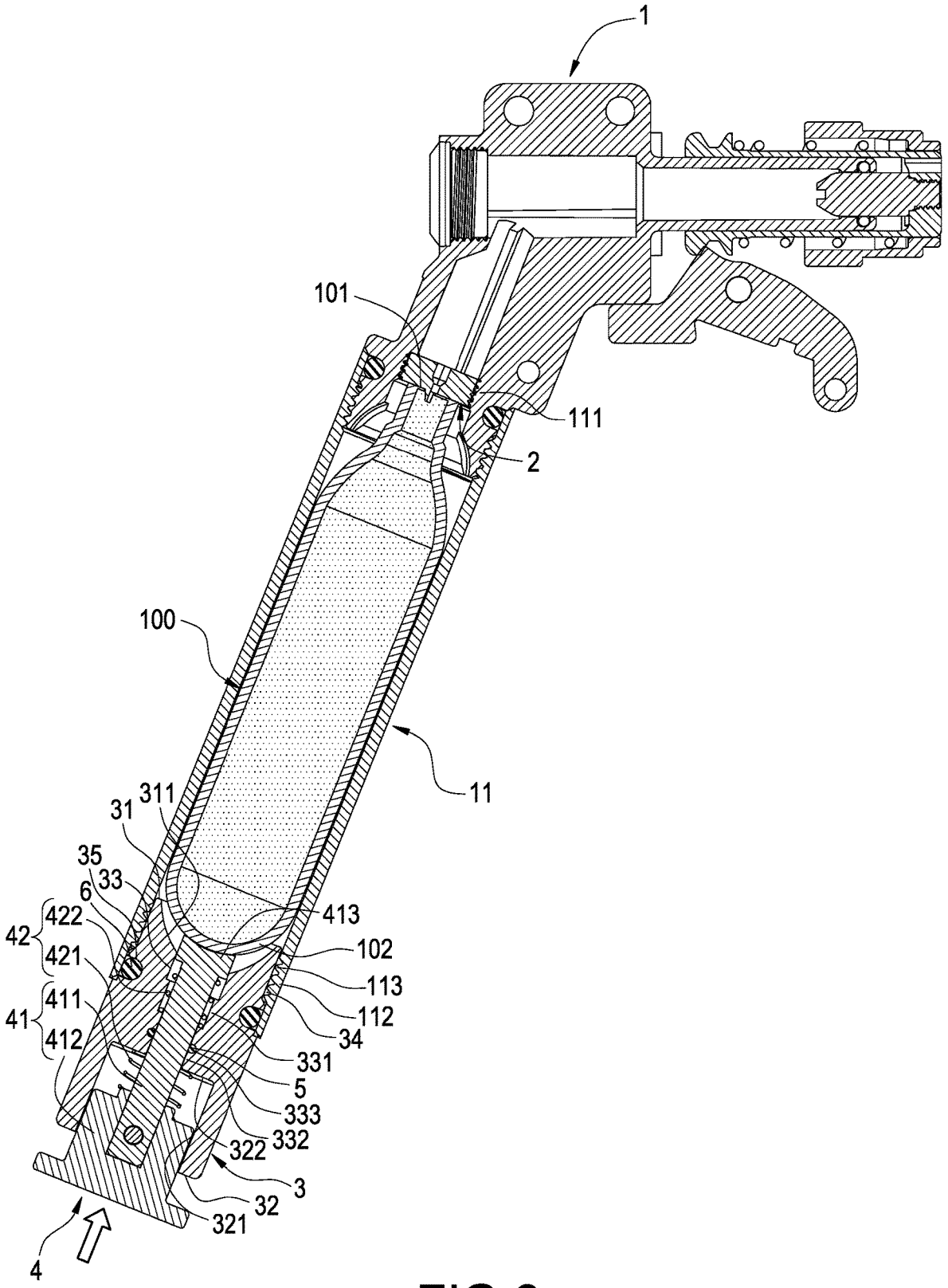
FIG. 3 is a schematic view of the toy gun capable of quickly piercing an air bottle of the present invention in an operational state.
Figure 4:
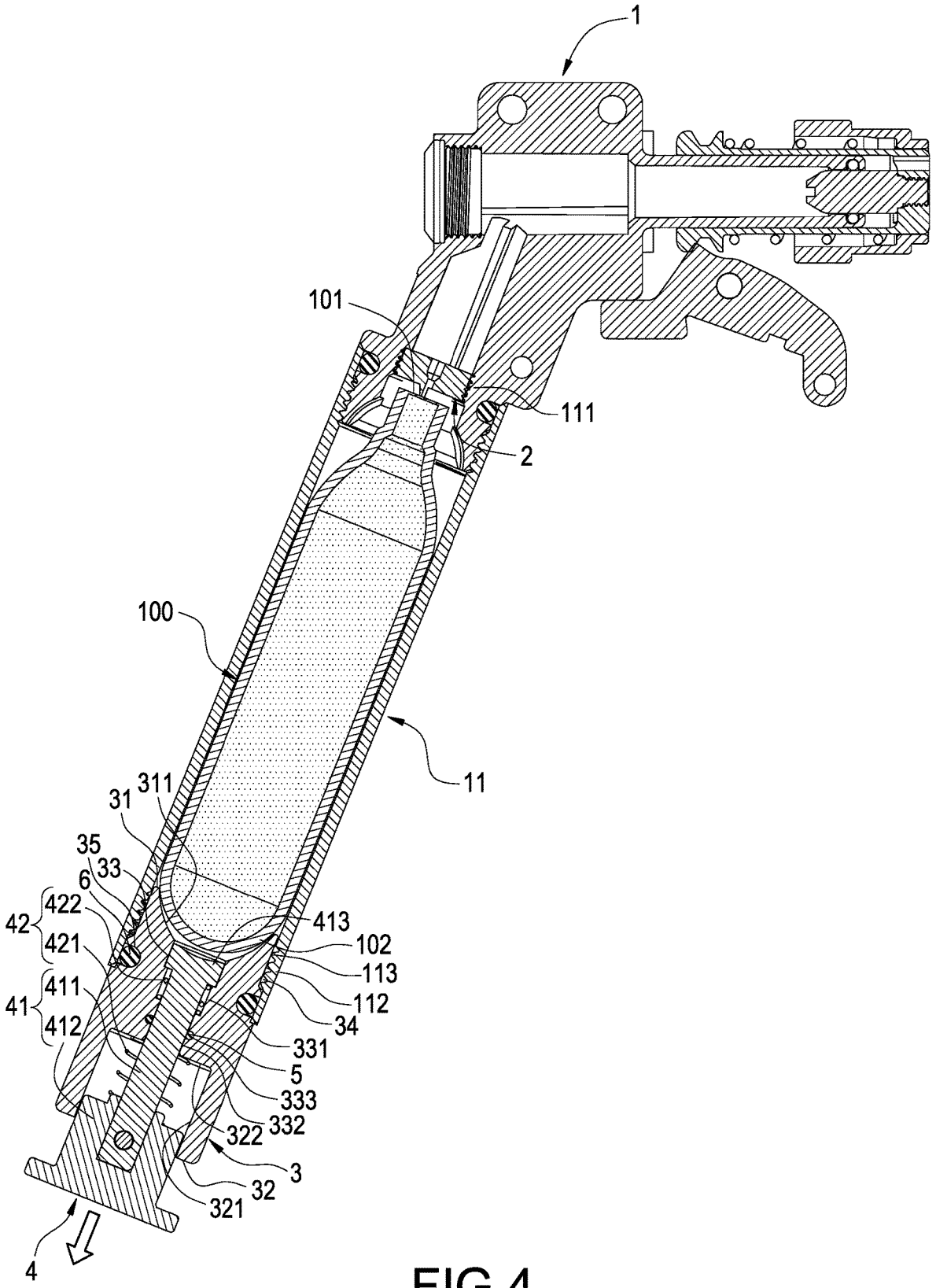
FIG. 4 is a schematic view of the toy gun capable of quickly piercing an air bottle of the present invention in another operational state.

FIGS. 3 and 4 are schematic views f the toy gun 10 of the present invention in operational states. After the air bottle 100 is installed in the air cylinder 11, the user presses the press block 412 to compress the first spring 421 and move the rod body 411 towards the interior of the air cylinder 11. Meanwhile, the extruded part 413 is pressed against the bottle bottom 102 of the air bottle 100 that is moved towards the piercing seat 2 until the bottle mouth 101 of the air bottle 100 is pierced by the piercing seat 2. The compressed air generated after the air bottle 100 is pierced flows into the gun barrel through the connecting tube 111 to shoot the bullet.

The traditional screw base needs to rotate more turns to push the air bottle into the air cylinder whereas the push rod 41 in the present invention is just pressed and then the air bottle 100 can be pushed into the air cylinder 11 such that the air bottle 100 can be quickly pierced by the piercing seat 2. That is, the toy gun 10 has the effect of quickly piercing the air bottle 100.

Furthermore, the spring return force of the first spring 421 can return the extruded part 413 to be received in the throughhole 33 such that the extruded part 413 can remain in the throughhole 33 and cannot touch the air bottle 100 when the push rod 41 is not pressed by the user. Such a design can prevent the air bottle 100 from being carelessly touched to be pierced by the piercing seat 2.

In summary, the toy gun capable of quickly piercing an air bottle of the present invention indeed achieves the expected objectives and overcomes the disadvantages of the prior art. Also, the present invention is novel, useful, and non-obvious to be patentable. Please examine the application carefully and grant it as a formal patent for protecting the rights of the inventor.

What is claimed is:

1. A toy gun capable of quickly piercing an air bottle installed therein, the toy gun comprising:

a gun body having an air cylinder, wherein one end of the air cylinder is provided with a connecting tube and the other end of the air cylinder is provided with a screwed tube, wherein the air bottle is received in the air cylinder;

a piercing seat disposed in the connecting tube;

a screw base having an end screwed to the screwed tube and the other end with a bottom end, wherein the screw base is provided with a throughhole penetrating through the bottom end and communicating with the interior of the air cylinder; and a moveable rod assembly having a push rod that can move to penetrate through the throughhole and to protrude from the bottom end and a return spring flexibly held between the screw base and the push rod, wherein when the push rod is pressed, the push rod can move the air bottle towards the piercing seat to be pierced by the piercing seat.

2. The toy gun capable of quickly piercing an air bottle according to claim 1, wherein the bottom end is provided with a recess portion and a bottom surface formed in the recess portion, wherein the throughhole is formed through the bottom surface.

3. The toy gun capable of quickly piercing an air bottle according to claim 2, wherein the push rod has a rod body and a press block attached firmly to the rod body, wherein the rod body is disposed through the throughhole, wherein the press block protrudes from the bottom end and is moveably embedded in the recess portion.

4. The toy gun capable of quickly piercing an air bottle according to claim 3, wherein an extruded part extends from an end of the rod body away from the press block, wherein an inner edge of the throughhole extends to form a first projection that can stop the extruded part.

5. The toy gun capable of quickly piercing an air bottle according to claim 4, wherein the inner edge of the throughhole extends to form a second projection, wherein the return spring has a first spring and a second spring, wherein the first spring is clamped between the bottom surface and the press block, wherein the second spring is clamped between the extruded part and the second projection, wherein the first spring drives the extruded part to be received in the throughhole.

6. The toy gun capable of quickly piercing an air bottle according to claim 5, further comprising a first seal ring that is clamped between the rod body and the screw base, wherein a first ring groove is disposed between the first projection and the second projection at the inner edge of the throughhole to receive the first seal ring.

7. The toy gun capable of quickly piercing an air bottle according to claim 6, further comprising a second seal ring that is clamped between the screwed tube and the screw base, wherein a second ring groove is disposed at an outer edge of the screw base to receive the second seal ring.

8. The toy gun capable of quickly piercing an air bottle according to claim 7, wherein an internal thread is disposed at an inner edge of the screwed tube, wherein an outer edge of the screw base is provided with an external thread engaged with the internal thread.

9. The toy gun capable of quickly piercing an air bottle according to claim 8, wherein the screwed tube has a top end at which a U-shaped recess is formed.

* * * * *